US010819009B2

(12) United States Patent
Komulainen et al.

(10) Patent No.: US 10,819,009 B2
(45) Date of Patent: Oct. 27, 2020

(54) APPARATUS AND METHOD FOR TRANSMISSION OF MILLIMETER WAVE SIGNALS

(71) Applicant: Intel Corporation, Santa Clara, CA (US)

(72) Inventors: Mikko S. Komulainen, Tampere (FI); Mikko M. Lampinen, Nokia (FI); Petri T. Mustonen, Tampere (FI); Saku Lahti, Tampere (FI)

(73) Assignee: Intel Corporation, Santa Clara, CA (US)

( * ) Notice: Subject to any disclaimer, the term of this patent is extended or adjusted under 35 U.S.C. 154(b) by 974 days.

(21) Appl. No.: 15/174,786

(22) Filed: Jun. 6, 2016

(65) Prior Publication Data

US 2017/0352944 A1 Dec. 7, 2017

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 1/22*** | (2006.01) |
| ***H01P 3/12*** | (2006.01) |
| ***H01P 5/107*** | (2006.01) |
| ***H01P 3/127*** | (2006.01) |
| ***H01Q 21/28*** | (2006.01) |
| ***H01P 1/02*** | (2006.01) |

(52) U.S. Cl.

CPC ..... *H01Q 1/243* (2013.01); *H01P 1/02* (2013.01); *H01P 3/121* (2013.01); *H01P 3/127* (2013.01); *H01P 5/107* (2013.01); *H01Q 1/2208* (2013.01); *H01Q 1/38* (2013.01); *H01Q 9/045* (2013.01); *H01Q 9/0407* (2013.01); *H01Q 21/28* (2013.01)

(58) Field of Classification Search

CPC ..... H01Q 1/243; H01Q 1/38; H01Q 9/0407; H01Q 9/045; H01Q 21/28

See application file for complete search history.

(56) References Cited

U.S. PATENT DOCUMENTS

| | | | |
|---|---|---|---|
| 6,552,636 B1 | 4/2003 | Yuanzhu | |
| 2010/0085133 A1 | 4/2010 | Nomura et al. | |
| 2017/0201028 A1 * | 7/2017 | Eberhardt | H01P 3/06 |

FOREIGN PATENT DOCUMENTS

| | | |
|---|---|---|
| EP | 2330683 A1 | 6/2011 |

OTHER PUBLICATIONS

"European Application Serial No. 17170619.5, Communication Pursuant to Article 94(3) EPC dated Mar. 25, 2019", 8 pgs.

(Continued)

*Primary Examiner* — Graham P Smith

(74) *Attorney, Agent, or Firm* — Schwegman Lundberg & Woessner, P.A.

(57) ABSTRACT

Embodiments relate to systems, methods, and computer-readable media to enable a wireless communication device. In one embodiment a wireless communication device is configured to radiate a millimeter wave signal through a circular waveguide. A patch antenna is resonated in a Transverse Magnetic 1-0 (TM10) operating mode and electrically couples to an open end of the circular waveguide. The electric field pattern of the patch antenna is such that the millimeter wave signal is launched into the waveguide propagating in a Transverse Electric 1-1 (TE11) mode. In other embodiments, various other configurations may be used as described herein.

26 Claims, 12 Drawing Sheets

(56) References Cited

OTHER PUBLICATIONS

"European Application Serial No. 17170619.5, Extended European Search Report dated Nov. 7, 2017", 19 pgs.
"High gain microstrip fed slot coupied hybrid antenna for MMW applications", Radio and Wireless Symposium (RWS), 2012 IEEE, IEEE, 15,XP032153376 DOI: 10.1109/RWS.2012.6175329ISBN: 978-1-4577-1153-4, (Jan. 15, 2012), 303-306.
"Millimeter-Wave Microstrip Line to Waveguide Transition Fabricated on a Single Layer Dielectric Substrate", Leice Transactions on Communications, Communications Society, Tokyo, Jp,vol. E85B, No. 6,Jun. 1 2002 (Jun. 1, 2002) XP001505919, ISSN: 0916-8516, (Jun. 1, 2002), 1169-1177.
"European Application Serial No. 17170619.5, Response filed Jul. 22, 2019 to Communication Pursuant to Article 94(3) EPC dated Mar. 25, 2019", *acknowledgment receipt included due to date discrepency between letter to EPO and Receipt date, 14 pgs.

* cited by examiner

APPARATUS AND METHOD FOR TRANSMISSION OF MILLIMETER WAVE SIGNALS

TECHNICAL FIELD

Embodiments pertain to wireless networks and wireless communication devices. Some embodiments relate to wireless local area networks (WLANs) and Wi-Fi networks including networks operating in accordance with the IEEE 802.11 family of standards, such as the IEEE 802.11ac standard, the IEEE 802.11ax study group (SG) (named DensiFi) and WiGig. Other embodiments pertain to mobile wireless communication devices such as the 5G standard. The embodiments herein particularly relate to the efficient transmission and reception of millimeter wave electromagnetic signals.

BACKGROUND

Wireless communication has been evolving toward ever increasing data rates (e.g., from IEEE 802.11a/g to IEEE 802.11n to IEEE 802.11ac). Currently, 5G and WiGig standards are being introduced for mobile wireless devices and Wireless Local Area Networks (WLAN) respectively. In high-density deployment situations, the utilization of available bandwidth becomes increasingly important. In response to this, an effort has been made to utilize higher frequency bands extending into the millimeter wave range. However, at this frequency, the radiation and transmission line properties for millimeter wave radio become very significant and even the smallest of transmission line discontinuities and parasitics become significant. Efficient methods are needed to transmit and receive millimeter wave signals that are both economical and robust.

DETAILED DESCRIPTION

Embodiments relate to systems, devices, apparatus, assemblies, methods, and computer-readable media to enhance wireless communications, and particularly to communication systems using phased array antennas. The following description and the drawings illustrate specific embodiments to enable those skilled in the art to practice them. Other embodiments can incorporate structural, logical, electrical, process, and other changes. Portions and features of some embodiments can be included in, or substituted for, those of other embodiments, and are intended to cover all available equivalents of the elements described.

Figure 1:
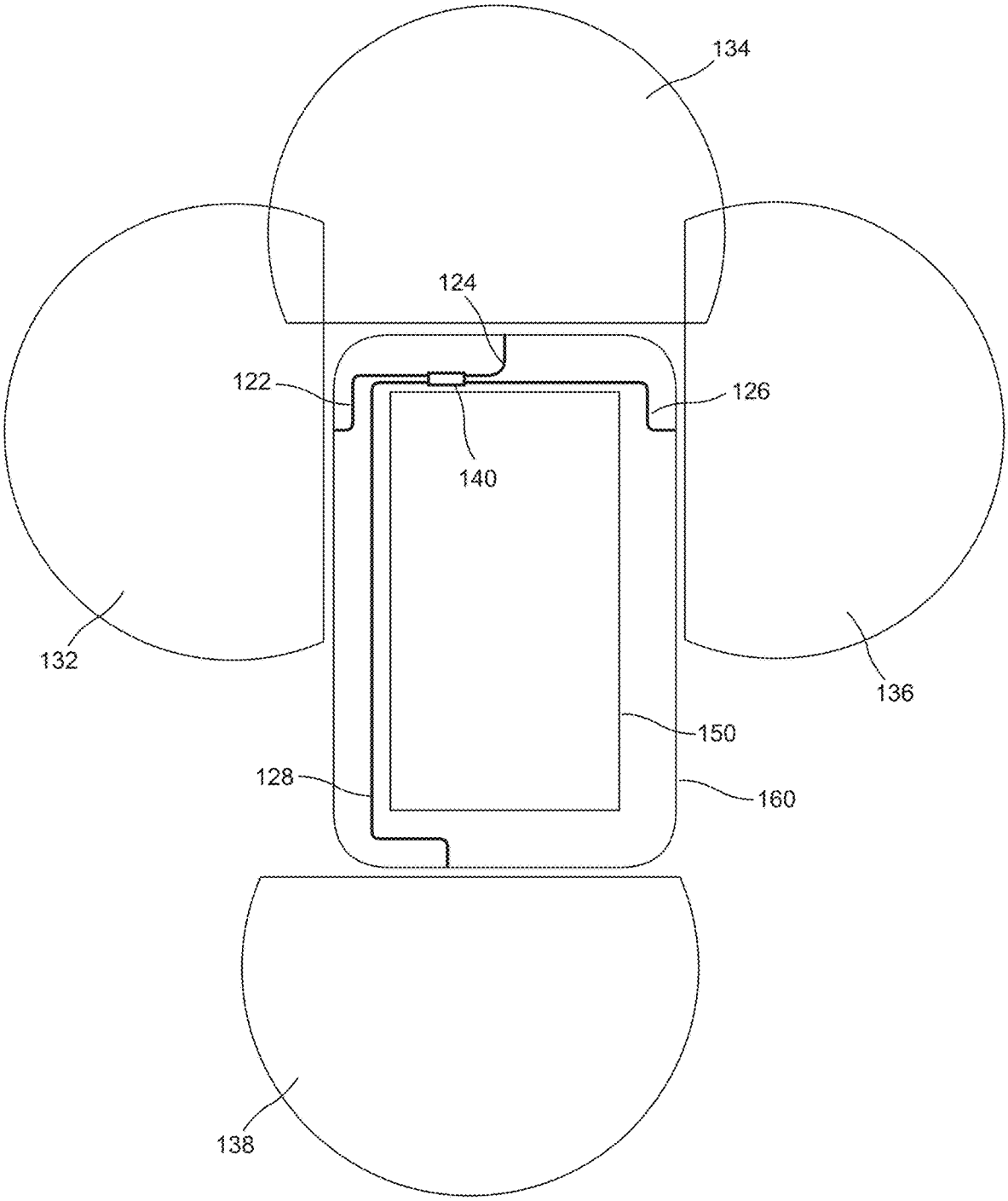
FIG. 1 illustrates a mobile device with multiple WiGig antenna feeds and multiple antennas according to some embodiments.

FIG. 1 illustrates a mobile device with multiple WiGig antenna feeds and multiple antennas in accordance with some embodiments. In the embodiment of FIG. 1, one for each direction from a mobile phone 160 is illustrated. Since one of the frequency bands that WiGig is intended to operate is at 60 GHz, waveguides are a particularly attractive method for signal transmission. This is because the waveguide structure is scalable in proportion to the wavelength. As the wavelength becomes very short, the size of the waveguide shrinks to a physical form that can be practically implemented in a mobile device. The waveguide can be efficiently adapted to transmit and receive millimeter-wave (mm-wave) radiation. An open end may also be used to radiate mm-wave energy into free space without the use of horn antenna or other such impedance matching device. However, mm-wave lengths are so short that even the smallest transmission line discontinuities and parasitics become significant. Therefore, there is a need to build efficient waveguide transmission systems and particularly to perform transitions between different waveguide structures. Such transitions are often needed from two-conductor transmission lines to single conductor transmission lines. Further, the propagation of millimeter (mm) waves is more akin to that of light waves; it is more directional and does not penetrate objects as easily. One method to radiate energy in all directions is to have four waveguides 122, 124, 126 and 128 each creating a corresponding radiation pattern 132, 134, 136 and 138. Each waveguide 122, 124, 126 and 128 is designed to efficiently carry mm-wave electromagnetic energy from the waveguide adapter 140 to an output. The waveguide adapter 140 implements the transition from a two-conductor transmission line to a single-conductor transmission line for each waveguide 122, 124, 126, and 128.

Waveguides are single-conductor transmission lines that can guide the flow of electromagnetic energy. The shape and size of the waveguide determines the frequency or frequencies which can propagate through the waveguide and those which cannot. The cutoff frequency is the minimum frequency which the waveguide can operate and under that frequency radiation will not propagate. In this manner, the waveguide behaves as a high pass filter. Waveguides can operate in a number of different modes, specifically designated by these general categories: Transverse Electro-Magnetic (TEM), Transverse Electric (TE) and Transverse Magnetic (TM). Two-conductor transmission lines can support TE, TM and TEM modes. Single-conductor lines can only support TE and TM modes. The transverse designation refers to the fact that the electric field or magnetic field is entirely contained within the plane transverse to that which the electromagnetic wave is travelling. In a TE mode, the electric field vector is always transverse to the direction of propagation. In a TM mode, the magnetic field vector is always transverse to the direction of propagation. Waveguides are also categorized by their cross sectional shape. For example, a rectangular waveguide has a rectangular cross section. The operating mode number indicates the number of half wavelengths along a side of the cross sectional rectangle. The electromagnetic field pattern inside the waveguide depends on the operating mode. The electromagnetic field pattern is defined by the direction and strength of the electric and magnetic fields inside the waveguide. Each operating mode also has a different cutoff frequency (generally higher mode numbers have higher cutoff frequencies.) The dominant mode is defined as the operating mode with the lowest cutoff frequency. For rectangular waveguides, the dominant mode is the TE10 mode; for circular waveguides, the dominant mode is the TE11 mode. Note that it is possible for a waveguide to simultaneously support electromagnetic waves propagating in different operating modes. This condition, however, is generally considered undesirable and can be avoided by exciting the waveguide above the cutoff frequency of the dominant mode but below the cutoff frequency of all other operating modes.

Figure 2:
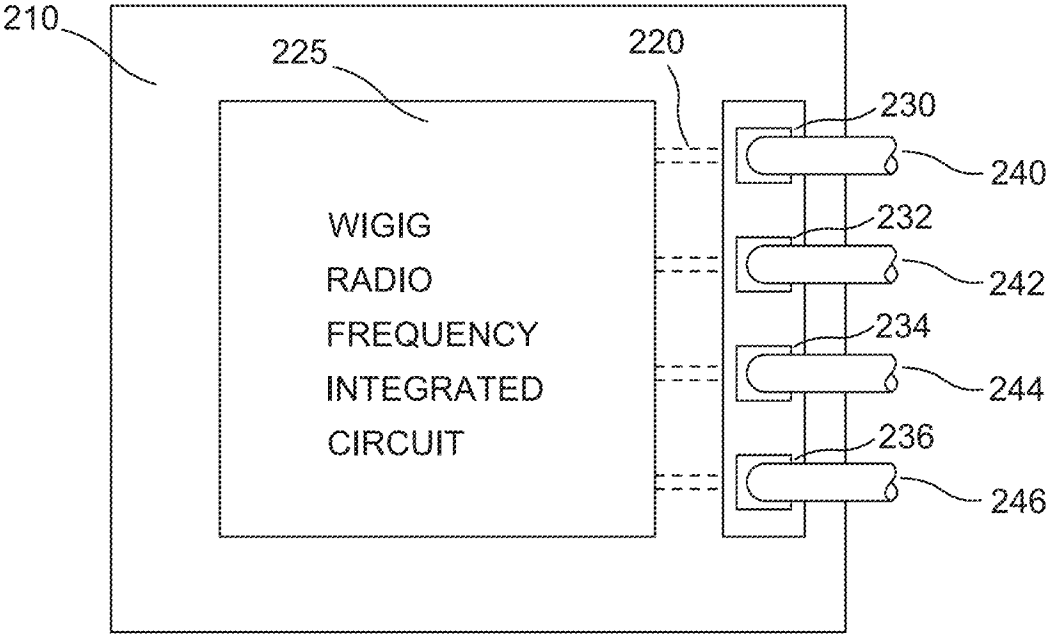
FIG. 2 is a drawing of a radio frequency front end module comprising a radio frequency integrated circuit (RFIC), a plurality of waveguides, and a plurality of waveguide adapters to transition from a printed circuit board (PCB) to the waveguides in accordance with some embodiments.

FIG. 2 is a drawing of a radio frequency front end module comprising a radio frequency integrated circuit (RFIC) 225, a plurality of waveguides 240, 242, 244, and 246, and a plurality of waveguide adapters 230, 232, 234 and 236 to transition from a printed circuit board (PCB) to the waveguides in accordance with some embodiments. The RFIC 225 is mounted on a printed circuit board (PCB) substrate 210. The RFIC 225 is comprised of power amplifiers or low noise amplifiers (or both) and other RF components to transmit and receive mm-wave signals. The millimeter wave signals are carried to the waveguide adapters 230, 232, 234 and 236 through transmission lines 220 (possibly two conductor transmission lines such as stripline). The waveguide adapters 230, 232, 234 and 236 transmit the RF energy from the printed circuit board (PCB) transmission lines 220 to the waveguides 240, 242, 244, and 246. The waveguide adapters 230, 232, 234 and 236 also transmit RF energy from the waveguides 240, 242, 244, and 246 back to the printed circuit board transmission lines 220 (the waveguide adapters are bi-directional). The embodiments described herein are methods for efficiently and inexpensively implementing the waveguide adapters that perform the transition from PCB to waveguides.

Figure 3:
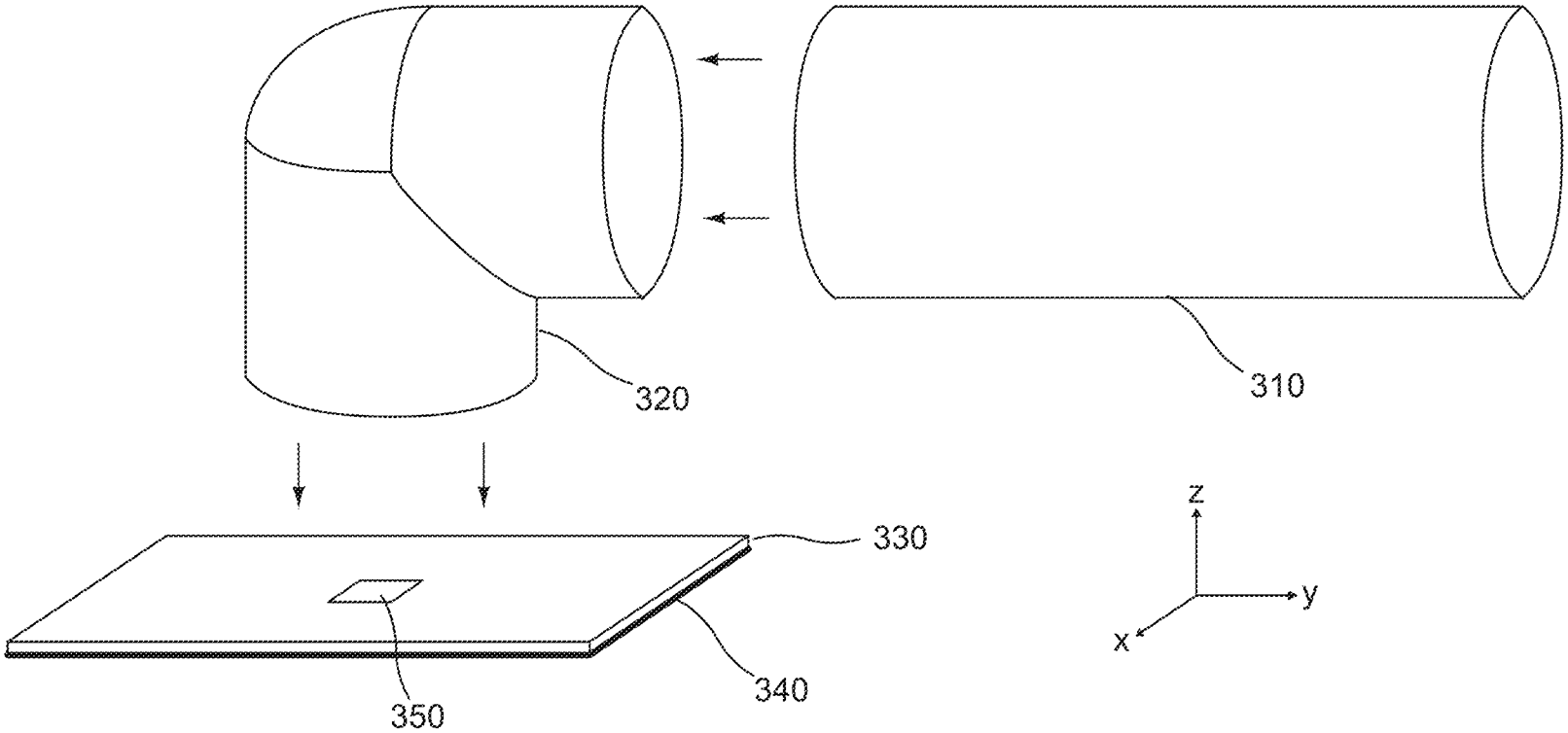
FIG. 3 is an illustration of the assembly of a waveguide adapter made up of a patch antenna and a circular waveguide with an elbow joint in accordance with some embodiments.

FIG. 3 is an illustration of the assembly of a waveguide adapter (such as one of waveguide adapters 230, 232, 234 and 236) made up of a patch antenna and a circular waveguide 310 with an elbow joint (a 90-degree bend) 320 in accordance with some embodiments. The circular waveguide 310 connects directly to the circular waveguide elbow joint 320. The patch antenna can be constructed as part of the PCB where the patch antenna is comprised of a metal patch 350, an antenna ground plane 340 and a dielectric board material 330. The 90-degree circular waveguide elbow joint 320 is placed directly over the metal patch 350 to efficiently teed the RF energy to the waveguide 310.

Figure 4:
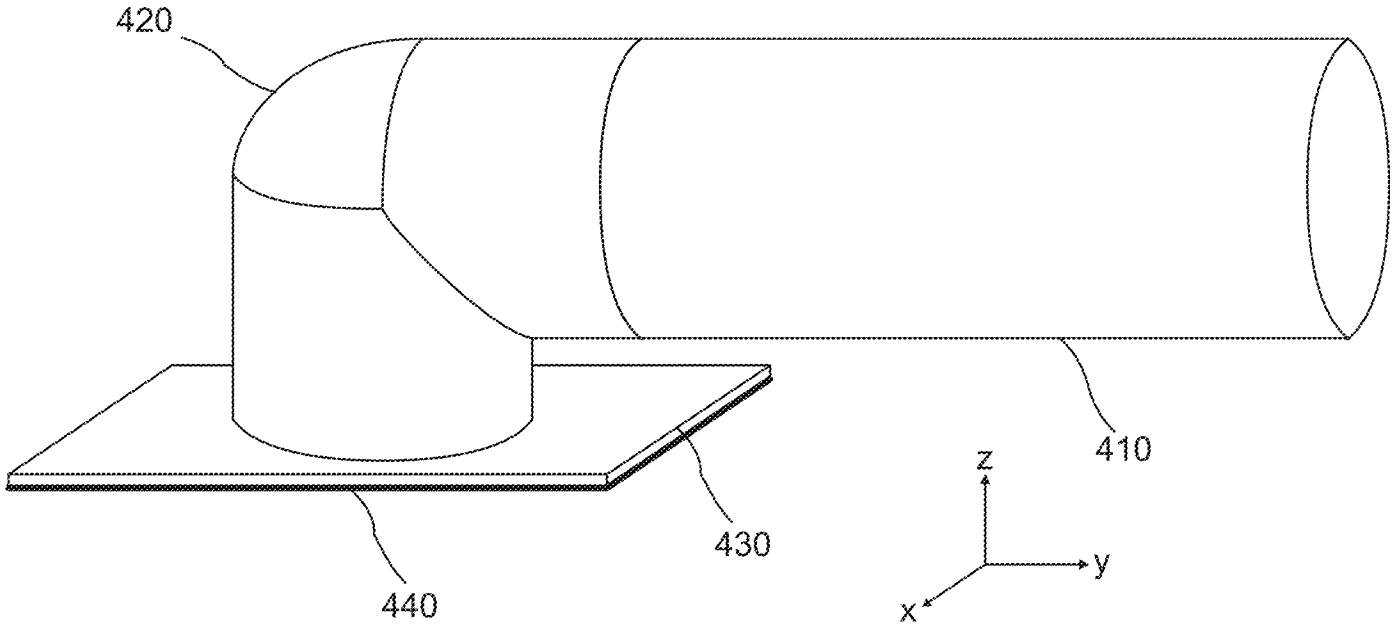
FIG. 4 shows a waveguide adapter comprised of a patch antenna and a circular waveguide with an elbow joint after assembly in accordance with some embodiments.

FIG. 4 shows the waveguide adapter of FIG. 3 comprised of a patch antenna and a circular waveguide 410 with an elbow joint 420 after assembly in accordance with some embodiments. The circular waveguide 410 is connected to the 90-degree circular waveguide elbow joint 420 which has been placed over the metal patch 350. The patch antenna is built into the PCB with an antenna ground plane 440 and dielectric material 430. The patch antenna is connected to an antenna feed protruding up through the antenna ground plane 440 and the dielectric material 430. The purpose of the patch antenna is to efficiently launch a propagating electromagnetic wave into the circular waveguide 410. Once the RF wave has been effectively launched into the circular waveguide elbow joint 420, the waveguide 410 carries the RF energy to the point of transmission in the wireless device. Conversely, when receiving a millimeter wave signal, the waveguide 410 carries the signal back to the patch antenna. The patch antenna is resonated by the mm-wave energy which excites the two-conductor transmission line in the PCB through the antenna feed. The two-conductor transmission line on the PCB carries the RF energy back to a receiver RFIC. The waveguide adapter is a reciprocal device (as are many passive electromagnetic structures) in that it can support the transmission of electromagnetic energy in either direction.

Figure 5:
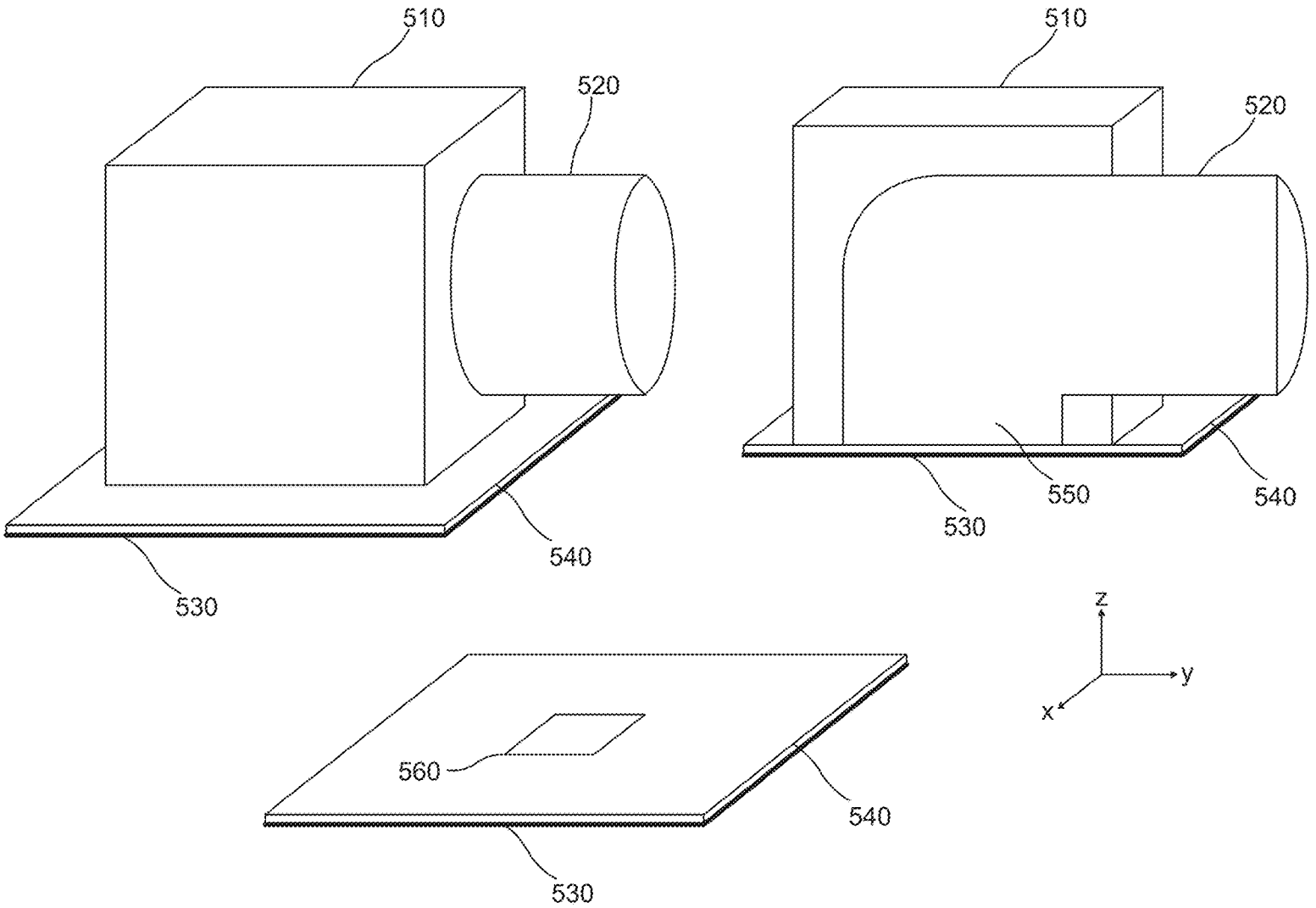
FIG. 5 is an illustration of the waveguide adapter, a cross section of the adapter, and the patch antenna that the waveguide adapter is mounted on in accordance with some embodiments.

FIG. 5 is an illustration of the waveguide adapter, a cross section of the adapter, and the patch antenna that the waveguide adapter is mounted on in accordance with some embodiments. The circular waveguide elbow joint 520 is encased in a block 510. The waveguide adapter is comprised of a circular waveguide elbow joint 520 which is possibly filled with a dielectric material 550 such as polytetrafluoroethylene (PTFE). The patch antenna is comprised of a metal patch 560, an antenna ground plane 530 and dielectric material 540. Here the metal patch 560 is a square-shaped conductive surface. When the waveguide adapter is mounted on top of the patch antenna, there is no conductive connection between the waveguide elbow joint 520 and the antenna ground plane 530 or the metal patch 560. The adapter could be mounted on electrically floating pads on the PCB; alternatively it could be attached using a non-conductive adhesive material. Other mechanical methods could be used as long as there is no conductive connection made between the metal patch 560, the patch antenna ground plane 530 and the waveguide elbow joint 520. The patch antenna feeds the signal to the open end of the adapter placed above it via electric field coupling. The patch antenna feed is not shown in the drawing but extends from underneath the patch antenna ground plane 530, up through the dielectric material 540, and connects to the metal patch 560. The antenna feed could be implemented as a through-hole-via making no conductive contact with the antenna ground plane 530.

A patch antenna comprises a flat "patch" of metal mounted over a ground plane and separated by some dielectric material. The flat metal patch will resonate with the ground plane at certain frequencies, specifically at frequencies where the length of the metal patch can be expressed as an integer multiple of half the wavelength. It is also possible for the patch antenna to resonate along the width of the metal patch where the width can be expressed as an integer multiple of half the wavelength. The electric field is maximum at the edge of the patch where it can radiate and the direction of radiation is orthogonal to the patch. The magnetic field of the patch is directed along the surface of the patch and between the patch and the ground plane. Since the magnetic field is transverse to the direction of the wave propagation, the operating mode is Transverse Magnetic. The antenna feed can be connected to the patch in such a way as to only resonate in one dimension (for example along the length). If that dimension is one half wavelength, then the operating mode is TM10, indicating one half wave length resonating along the length and with no resonance along the width.

The operating mode of the patch antenna determines the electromagnetic field pattern. As already described, one of the parameters which determines the operating mode is the dimensions of the metal patch with respect to the wavelength. The wavelength is largely determined by the thickness and relative permittivity of the dielectric material separating the metal patch with the ground plane. In some embodiments, an example dielectric material has a relative permittivity of between 2.9 and 3.2 and a patch thickness between 0.1 millimeters and 0.2 millimeters for an operation target of 60 GHz. In other embodiments, such characteristics will vary depending on the design. The type and position of the antenna feed also determine the operating mode. A typical antenna feed can be implemented by a via that connects a signal wire underneath the ground plane to the metal patch without making any electrical contact with the ground plane. If the patch antenna feed is connected along a centerline of the width, yet off center with respect to length of the metal patch, then this will tend to excite a resonant mode along the length, producing a TM10 operating mode.

Figure 6:
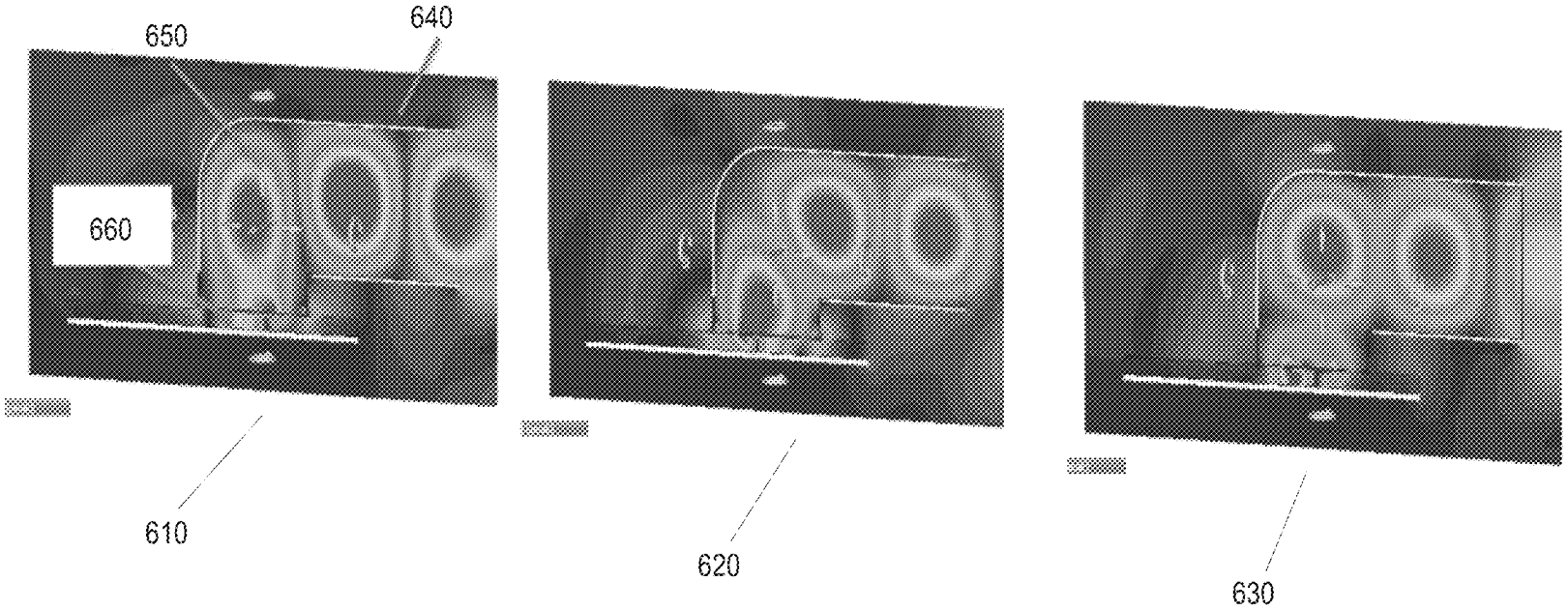
FIG. 6 shows a simulation of mm-wave being launched into a waveguide where the electric field intensity is shown at different phase points of the cycle in accordance with some embodiments.

FIG. 6 shows a simulation of mm-wave being launched into a waveguide 640 where the electric field intensity 650 is shown at different phase points of the cycle in accordance with some embodiments. While various embodiments are described herein as associated with mm-waves, it will be apparent that other embodiments may operate outside of mm-wave bands, as long as the waves are sufficiently guided by the structure of the associated embodiment. In the embodiment of FIG. 6, at 0 degrees (610), the horizontal electric field intensity is starting to increase at the patch antenna. The electric field couples to the open end of the waveguide 640. At 110 degrees (620), the electric field intensity peak has left the patch antenna travelling upward towards the elbow joint. At 220 degrees (630), the peak has moved into the elbow joint. At this point, the previous peak has transitioned past the elbow joint and into the horizontal portion of the waveguide. The simulation demonstrates the flow of electromagnetic energy being launched from the patch antenna and flowing around the 90-degree waveguide bend. Again, note that to allow for electric field coupling from the patch antenna to the waveguide 640, the waveguide 640 is open-ended (i.e., the end of the waveguide 640 cannot be shorted as would be the case if it were connected to the PCB ground plane.)

Figure 7:
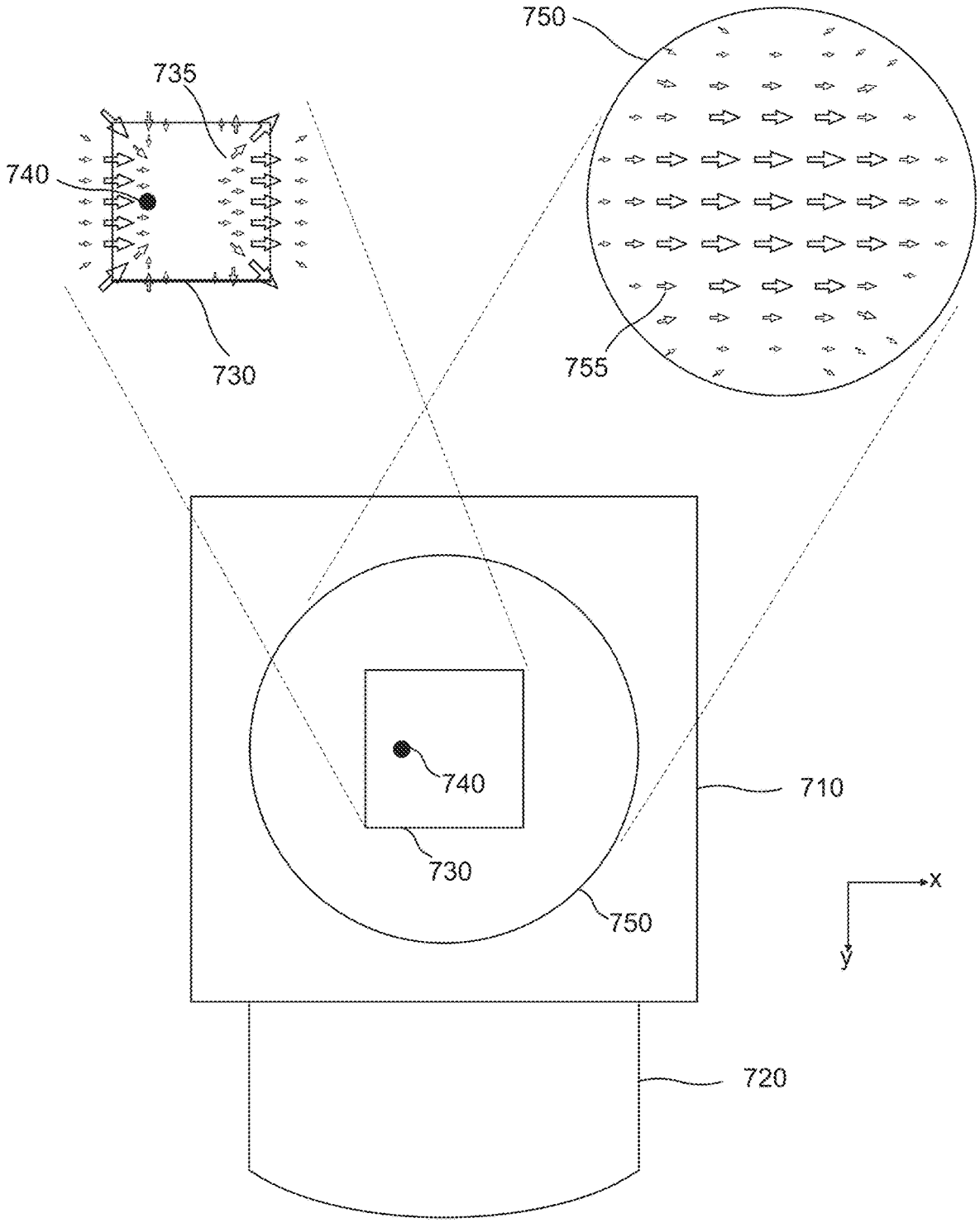
FIG. 7 shows a bottom view of the waveguide adapter and also illustrates the electric field pattern of the metal patch and a circular waveguide in accordance with some embodiments.

FIG. 7 shows a bottom view of the waveguide adapter 710 and also illustrates the electric field pattern of the metal patch 730 and a circular waveguide 720 in accordance with some embodiments. Note the relative xyz axis as compared with FIG. 3, FIG. 4, and FIG. 5 for spatial orientation. The bottom of the waveguide adapter 710 with the circular waveguide opening 750 is shown looking up into the elbow joint. The metal patch 730, the antenna feed 740 and the circular waveguide 720 are also shown. The metal patch 730 with its associated electric field 735, and the opening 750 of the circular waveguide 720 with its associated electric field 755, are shown above. Note the horizontal (x-direction) electric fields 735 and 755 are in agreement in terms of their orientation. This is the TM10 mode for the patch antenna 730 and the TE11 mode for the circular waveguide 720. Also note that the fringing fields of the patch antenna 730 are somewhat in agreement with the electric field at the edge of the circular waveguide opening 750. With this matching agreement in electric field patterns, the electromagnetic wave is efficiently launched into the adapter.

The orientation of the electric field in the adapter is controlled by the position of the antenna feed and by the shape of the patch antenna. As emphasized before, it is important for certain embodiments that the circular waveguide 720 be open-ended so as to allow for electric coupling to the patch antenna. Various other embodiments with differing waveguide or patch antenna shapes may operate differently. The metal patch 730 is connected to the antenna feed 740. The electric field 755 is horizontal (x-direction) as shown in FIG. 7 so as to properly transition through the 90-degree elbow joint. It is also important that the patch antenna 730 resonates at the operating frequency and that the electric field 735 of the antenna 730 and the electric field 755 of the waveguide 720 are similar. Here it can be seen that the directions of the electric fields 735, 755 are consistent, and even at the corners of the patch antenna 730, the fringing fields are somewhat consistent with the waveguide 720. The position of the antenna feed 740 is off centerline such that an electric field 735 is excited along the x-axis as shown. These are the electric field patterns for the TM10 and TE11 of the patch antenna 730 and the circular waveguide 720, respectively. The patch antenna 730 will resonate in this mode across a narrow band of operating frequencies in which the energy is most efficiently radiated. The position of the antenna feed 740 can be designed to provide minimal reflection coefficient over this band operating band. At the center of the metal patch 730, the current density is near maximum and the electric field is near zero. Moving towards the edge, the electric field increases and the current density decreases; at the edge of the metal patch the current density is zero. This translates to a method of conveniently adjusting the driving point impedance of the patch antenna. Specifically, as the antenna feed 740 is moved further off center and towards the edge, the driving point impedance increases. The metal patch 730 is then excited at the desired or operating frequency within this band. Finally, the waveguide cutoff frequency (the cutoff frequency for the TE11 mode, which is the dominant mode for a waveguide with a circular cross section) is designed low enough to allow electromagnetic energy to flow at the operating frequency. In the case of WiGig, the operating frequency is 60 GHz.

Figure 8:
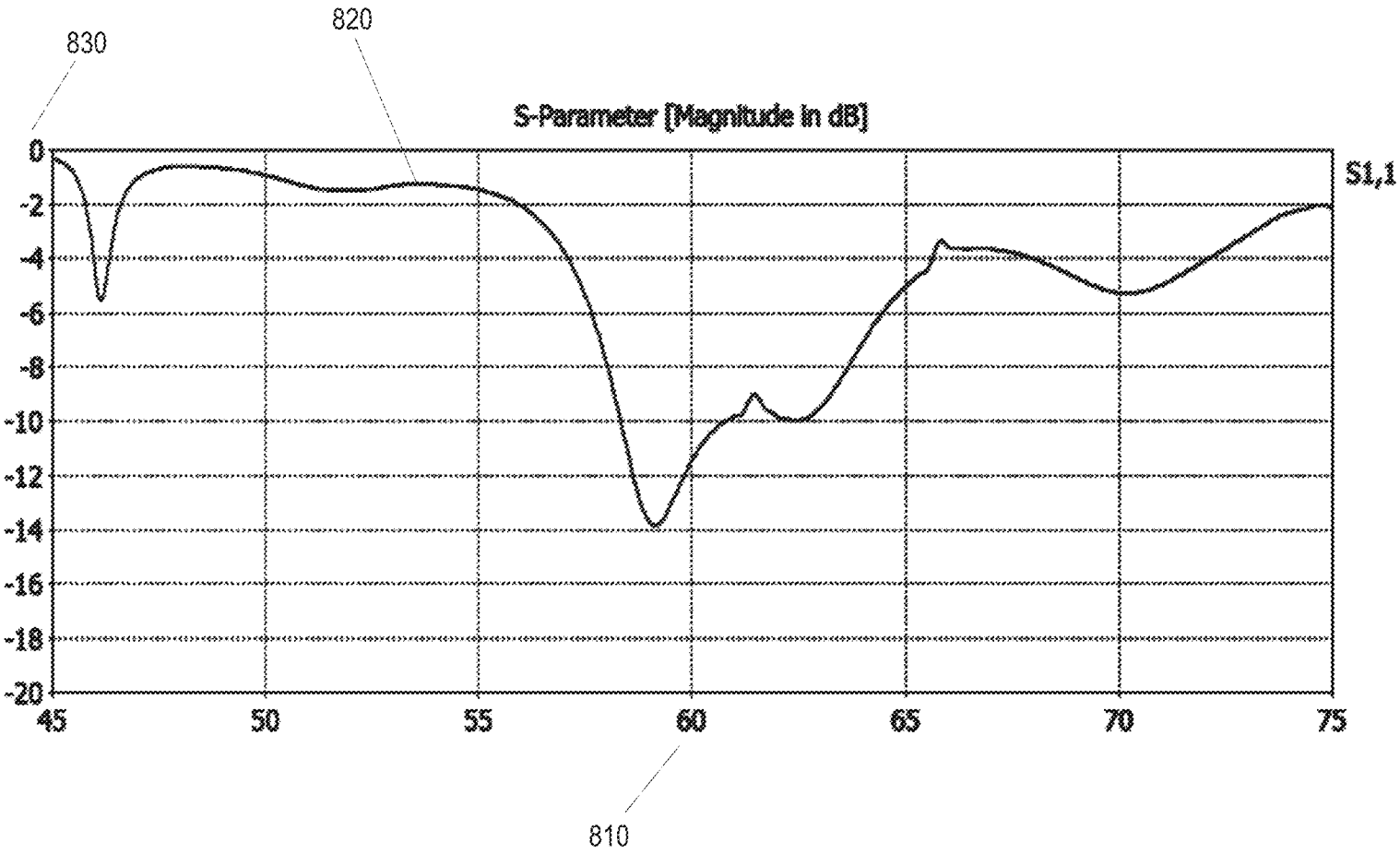
FIG. 8 is a plot of the reflection coefficient S11 of the waveguide over a range of operating frequencies in accordance with some embodiments.

FIG. 8 is a plot of the reflection coefficient S11 830 of the waveguide over a range of operating frequencies 810 in accordance with some embodiments. From the plotted S11 curve 820, it can be seen that the waveguide adapter exhibits less than 10% reflected power in a 50-ohm system. The reflection coefficient of the waveguide adapter depends greatly on the position of the antenna feed 740 with respect to the metal patch 730 as discussed above.

Figure 9:
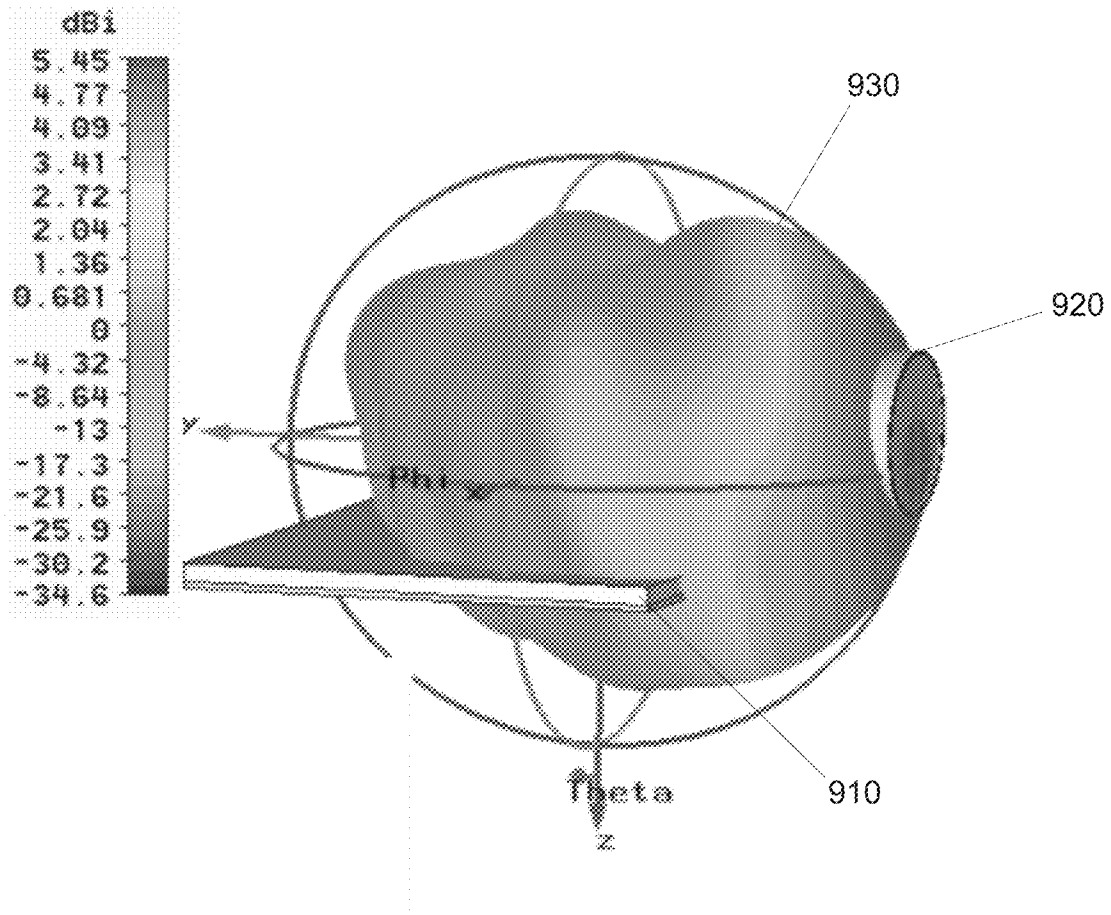
FIG. 9 is an illustration of the radiation pattern of a waveguide adapter when excited at 59 GHz in accordance with some embodiments.

FIG. 9 is an illustration of the radiation pattern of a waveguide adapter when excited at 59 GHz in accordance with some embodiments. The radiation 930 is expressed in decibels relative to an isotropic radiator (dBi). The PCB 910 is placed horizontally with the wave guide adapter on top of the PCB 910. The wave guide adapter protrudes up, through an elbow joint and to the right until it reaches the electromagnetic simulation boundary at 920. The actual adapter is obscured by the radiation pattern 930. However, it can be seen that radiation around the adapter is low (specifically where the waveguide meets up with the board), demonstrating that the adapter does not leak electromagnetic energy, but rather it effectively transmits the RF energy from the PCB to the waveguide.

Figure 10:
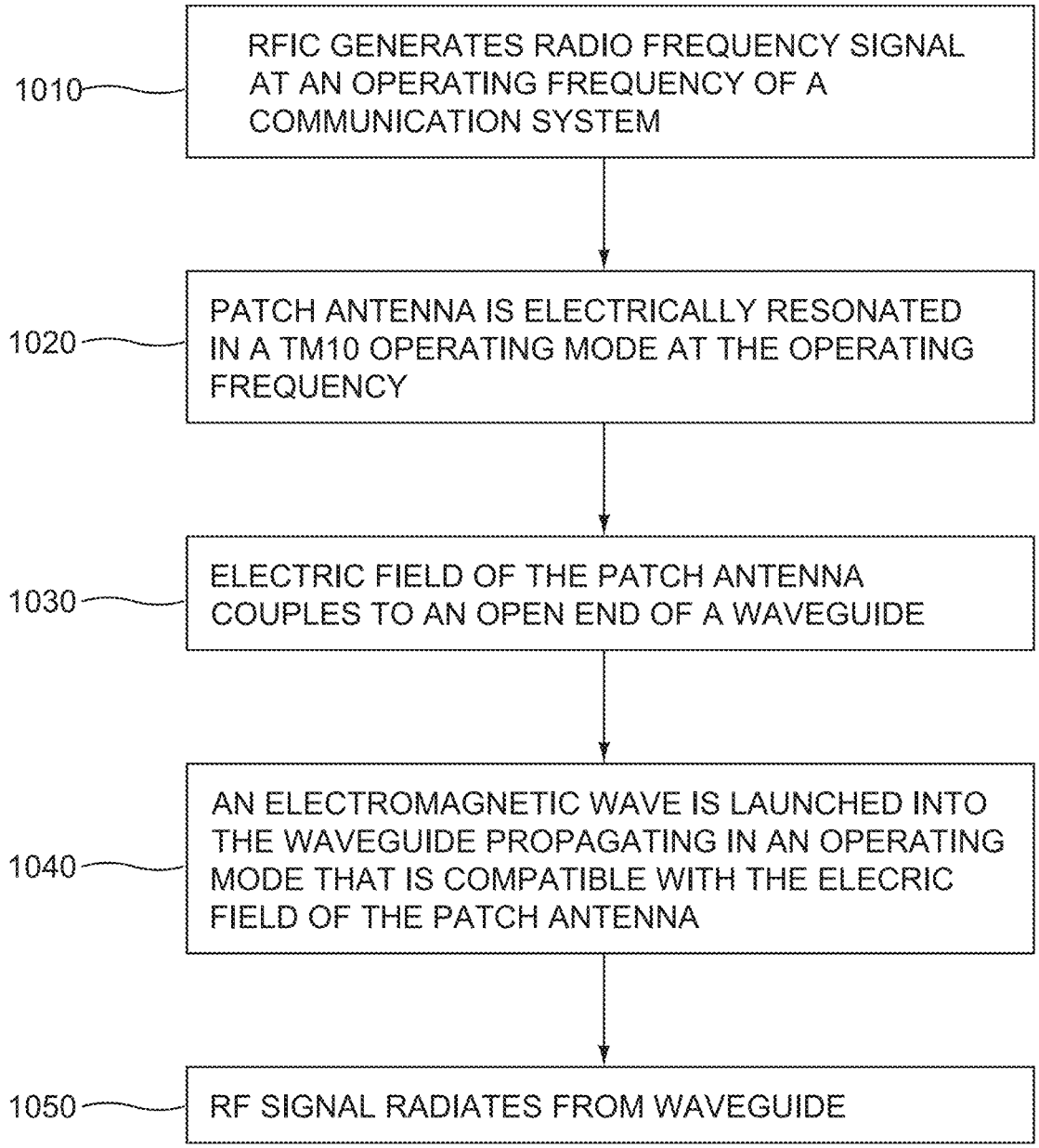
FIG. 10 shows the operational flow of the waveguide adapter when transmitting a mm-wave signal in accordance with some embodiments.

FIG. 10 shows the operational flow of the waveguide adapter when transmitting a mm-wave signal in accordance with some embodiments. In operation 1010, a radio frequency integrated circuit generates an RF signal driving into a transmission line inside the PCB (most likely a stripline). The transmission line carries the RF signal to the waveguide adapter. In operation 1020, the patch antenna is excited by the RF signal with an antenna feed that extends up from the stripline, through the patch antenna ground plane, and connects to the metal patch. The patch antenna is resonated in a TM10 mode where the electric field is polarized horizontally with respect to the open end of the waveguide (as described in FIG. 7), In operation 1030 the electric field of the patch antenna couples to the open end of the waveguide. In operation 1040, an electromagnetic wave is launched into the waveguide. The operating mode of the waveguide has an associated electric field pattern that is compatible with an electric field of the patch antenna (where the patch antenna is operating in a TM10 mode). For a circular waveguide, the compatible waveguide operating mode is TE11. For a rectangular waveguide, the compatible waveguide operating mode is TE10. The electromagnetic wave propagates through the waveguide and possibly through an elbow joint. The cutoff frequency of the waveguide as determined by the operating mode is less than the operating frequency. In operation 1050 the EM wave continues to propagate through a waveguide to the desired position in the wireless device where the EM wave is radiated into free space. Note that the waveguide operation described here is for transmitting an RF signal from a wireless device. The reverse operation applies equally well for receiving an RF signal through the waveguide adapter apparatus.

In other embodiments, the waveguide adapter can take a different structural shape, such as a rectangular waveguide or a square waveguide. The elbow joint may be mitered or square or may have a rounded bend when viewed as a cross section. The waveguide adapter supports (e.g., transmits) the electromagnetic wave at the operating frequency. This places requirements on the size and the relative dielectric constant of the material inside the waveguide such that the operating frequency is above the cutoff frequency. The waveguide can also be shaped to support any bends such as that shown in FIG. 5. The antenna can also be implemented with other types of antennas such as a dipole feed antenna, a slot antenna or a patch antenna with a different shape (other than square). Thus, in some embodiments, the size and shape of the patch antenna is co-designed along with the size and shape of the waveguide. Other forms for the antenna feed can be used, such as a microstrip feed, a coaxial feed, and other feeds that can efficiently couple to the patch antenna without any actual conductive contact.

In the example shown in FIG. 5, the square metal patch 560 is 0.95 millimeters (mm) by 0.95 mm with 0.5 oz copper cladding. The circular waveguide diameter is 2.4 mm. The dielectric PCB material is 0.3 mm thick with a relative permittivity (dielectric constant) of 3.38. The patch antenna feed is a via as described earlier.

Various embodiments are now described. It will be apparent that, although certain particular embodiments are described below and throughout this description, different combinations and various of the embodiments described herein are possible, including embodiments with elements not described combined with the elements that are described.

Example 1 is an electromagnetic transmission apparatus comprising: a waveguide comprising an open end, wherein the waveguide is associated with a waveguide operating mode and a characteristic cutoff frequency and wherein the characteristic cutoff frequency is less than a transceiver operating frequency; and a patch antenna configured to resonate at the transceiver operating frequency and further configured to electrically couple to the open end of the waveguide; wherein the patch antenna is further configured for a patch antenna operating mode associated with a patch antenna electric field pattern that is compatible with a waveguide electric field pattern associated with the waveguide operating mode.

In Example 2, the subject matter of Example 1 optionally includes, wherein the waveguide comprises a circular-shaped cross section; and wherein the waveguide is configured for transmission of millimeter waves.

In Example 3, the subject matter of Example 2 optionally includes, wherein the patch antenna comprises a square-shaped surface configured to electrically couple to the waveguide.

In Example 4, the subject matter of Example 3 optionally includes, wherein the waveguide comprises a right angle elbow joint and the patch antenna is configured to excite an electric field in a direction that is orthogonal to the plane formed by the right angle elbow joint.

In Example 5, the subject matter of any one or more of Examples 3-4 optionally include, wherein the waveguide operating mode is Transverse Electric 1-1 (TE11) and the patch antenna operating mode is Transverse Magnetic 1-0 (TM10).

In Example 6, the subject matter of any one or more of Examples 1-5 optionally include, where the open end of the waveguide is electrically isolated from an antenna ground plane associated with the patch antenna.

In Example 7, the subject matter of Example 6 optionally includes, wherein the open end of the waveguide is electrically isolated from the patch antenna.

In Example 8, the subject matter of any one or more of Examples 1-7 optionally include, wherein the waveguide further comprises a second open end configured to radiate energy into free space.

In Example 9, the subject matter of any one or more of Examples 1-8 optionally include, further comprising: a printed circuit board (PCB) wherein the patch antenna is constructed with two metal layers of a plurality of metal layers comprised within the PCB; and a signal line connected to an antenna feed that is constructed within the PCB, wherein the antenna feed is configured to excite the patch antenna in a TM10 operating mode.

In Example 10, the subject matter of Example 9 optionally includes, further comprising radio frequency circuitry connected to the signal line configured to transmit and receive mm-wave signals through the electromagnetic millimeter wave (mm-wave) transmission apparatus.

In Example 11, the subject matter of any one or more of Examples 9-10 optionally include, further comprising a plurality of signal lines, a plurality of patch antennas, and a plurality of waveguides, and further configured to transmit energy from each signal line of the plurality signal lines to one of the waveguides of the plurality of waveguides by exciting one of the patch antennas of the plurality of patch antennas.

In Example 12, the subject matter of Example 11 optionally includes, further comprising radio frequency circuitry connected to the plurality of signal lines configured to transmit and receive mm-wave signals through the electromagnetic millimeter wave (mm-wave) transmission apparatus.

In Example 13, the subject matter of any one or more of Examples 1-12 optionally include, wherein: the waveguide comprises a rectangular-shaped cross section; and the patch antenna comprises a rectangular-shaped surface configured to electrically couple to the waveguide.

In Example 14, the subject matter of Example 13 optionally includes, wherein the waveguide operating mode is Transverse Electric 1-0 (TE10) and the patch antenna operating mode is Transverse Magnetic 1-0 (TM10).

In Example 15, the subject matter of any one or more of Examples 5-14 optionally include, wherein a patch antenna feed is connected to a location on the patch antenna to cause the patch antenna to resonate in a TM10 operating mode and exhibit a scattering reflection coefficient of less than −8 dB at the transceiver operating frequency.

Example 16 is a method of mm-wave signal transmission comprising: exciting a rectangular-shaped patch antenna with a mm-wave signal and resonating the patch antenna in a TM10 operating mode; coupling an electric field of the patch antenna with an open end of a waveguide, the waveguide positioned with the open end over the patch antenna; and launching an electromagnetic wave into the open end of the waveguide wherein a waveguide electric field pattern is compatible with an electric field pattern of the patch antenna and a cutoff frequency of the waveguide is less than a frequency of the mm-wave signal.

In Example 17, the subject matter of Example 16 optionally includes, further comprising: launching an electromagnetic wave into the open end of a waveguide with a circular cross section, propagating the mm-wave signal in a TE11 operating mode.

In Example 18, the subject matter of any one or more of Examples 16-17 optionally include, further comprising: launching an electromagnetic wave into the open end of a waveguide with a rectangular cross section, propagating the mm-wave signal in a TE10 operating mode.

In Example 19, the subject matter of any one or more of Examples 16-18 optionally include, further comprising: generating a mm-wave signal with radio frequency circuitry connected to a signal line; and exciting the patch antenna through an antenna teed connected to the signal line wherein the antenna feed is positioned such that the patch antenna is resonating in the TM10 operating mode.

In Example 20, the subject matter of Example undefined optionally includes a non-transitory computer-readable medium comprising instructions that, when executed by one or more processors of a device comprising a wireless communication system, cause the device to: electrically resonate a patch antenna in a TM10 operating mode at an operating frequency of the wireless communication system, producing an electric field which couples to an open end of a waveguide; and launch an electromagnetic wave into the waveguide propagating in a waveguide operating mode wherein an electric field pattern of the waveguide operating mode is compatible with the electric field of the TM10 operating mode of the patch antenna, wherein a cutoff frequency of the waveguide is less than the operating frequency.

In Example 21, the subject matter of Example 20 optionally includes, wherein: the patch antenna comprises a square-shaped surface configured to electrically couple to the waveguide; and the waveguide comprises a circular-shaped cross section and configured for a TE11 operating mode.

In Example 22, the subject matter of any one or more of Examples 20-21 optionally include, wherein the waveguide operating mode is Transverse Electric 1-1 (TE11) and the patch antenna operating mode is Transverse Magnetic 1-0 (TM10).

In Example 23, the subject matter of any one or more of Examples 20-22 optionally include, further comprising instructions that cause the device to radiate energy into free space from a second open end of the waveguide.

In Example 24, the subject matter of any one or more of Examples 20-23 optionally include, further comprising instructions that cause the device to receive mm-wave signals at a second open end of the waveguide.

In Example 25, the subject matter of any one or more of Examples 20-24 optionally include, wherein: the patch antenna comprises a square-shaped surface configured to electrically couple to the waveguide; and the waveguide comprises a rectangular-shaped cross section and configured for the TE10 operating mode.

Example 26 is a radio frequency front end module comprising: a radio frequency integrated circuit (RFIC); a plurality of waveguide adapters coupled to the RFIC; a plurality of waveguides associated with a plurality of corresponding radiation patterns, and coupled to a corresponding waveguide adapter of the plurality of waveguide adapters, wherein the plurality of waveguides are associated with a waveguide operating mode and a characteristic cutoff frequency and wherein the characteristic cutoff frequency is less than a transceiver operating frequency; and a plurality of patch antennas corresponding to pairs of waveguide adapters and waveguides of the plurality of waveguide adapters and the plurality of waveguides, the plurality of patch antennas configured to resonate at the transceiver operating frequency and further configured to electrically couple to an open end of a corresponding waveguide of the plurality of waveguides; wherein the plurality of patch antennas are further configured for a patch antenna operating anode associated with a patch antenna electric field pattern that is compatible with a waveguide electric field pattern associated with the plurality of corresponding radiation patterns.

Example 27 is The radio frequency front end module further comprising: a substrate comprising one or more of a printed circuit board, a glass substrate, a ceramic substrate, and a semiconductor substrate; wherein the RFIC and the plurality of waveguide adapters are mounted to the substrate and coupled via a plurality of transmission lines.

In Example 28, the subject matter of any one or more of Examples 26-27 optionally include wherein the plurality of waveguides each comprises a circular-shaped cross section; and wherein each waveguide is configured for transmission of millimeter waves.

In Example 29, the subject matter of any one or more of Examples 26-28 optionally include wherein each patch antenna comprises a square-shaped surface configured to electrically couple to the waveguide.

In Example 30, the subject matter of any one or more of Examples 26-29 optionally include wherein each waveguide comprises a right angle elbow joint and the patch antenna is configured to excite an electric field in a direction that is orthogonal to the plane formed by the right angle elbow joint.

In Example 31, the subject matter of Example 30 optionally includes wherein each waveguide operating mode is Transverse Electric 1-1 (TE11) and each patch antenna operating mode is Transverse Magnetic 1-0 (TM10).

In Example 32, the subject matter of any one or more of Examples 26-31 optionally include, where the open end of each waveguide is electrically isolated from an antenna ground plane associated with the patch antenna.

In Example 33, the subject matter of any one or more of Examples 26-32 optionally include wherein the open end of each waveguide is electrically isolated from the patch antenna.

In Example 34, the subject matter of any one or more of Examples 26-33 optionally include, wherein each waveguide further comprises a second open end configured to radiate energy into free space.

In Example 35, the subject matter of any one or more of Examples 26-34 optionally include wherein each waveguide is associated with a slit or hole in a waveguide metal wall configured for radiation of energy into free space via the slit or hole.

In Example 36, the subject matter of any one or more of Examples 26-35 optionally include further comprising: a printed circuit board (PCB) wherein each patch antenna is constructed with two metal layers of a plurality of metal layers comprised within the PCB; and a plurality of signal line connected to a plurality of antenna feeds that are constructed within the PCB, wherein the plurality of antenna feeds are configured to excite each patch antenna in a TM10 operating mode.

In Example 37, the subject matter of Example 36 optionally includes, further comprising radio frequency circuitry connected to the signal line configured to transmit and receive mm-wave signals through the RFIC.

In Example 38, the subject matter of any one or more of Examples 36-37 optionally include, wherein: each waveguide comprises a rectangular-shaped cross section; and each patch antenna comprises a rectangular-shaped surface configured to be electrically couple to the waveguide.

In Example 39, the subject matter of Example 38 optionally includes, wherein the waveguide operating mode is Transverse Electric 1-0 (TE10) and the patch antenna operating anode is Transverse Magnetic 1-0 (TM10).

Example 40 is an apparatus for signal transmission comprising: means for exciting a rectangular-shaped patch antenna with a mm-wave signal and resonating the patch antenna in a TM10 operating mode; means for coupling an electric field of the patch antenna with an open end of a waveguide, the waveguide positioned with the open end over the patch antenna; and means for launching an electromagnetic wave into the open end of the waveguide wherein a waveguide electric field pattern is compatible with an electric field pattern of the patch antenna and a cutoff frequency of the waveguide is less than a frequency of the mm-wave signal.

In Example 41, the subject matter of Example 40 optionally includes further comprising: means for launching an electromagnetic wave into the open end of a waveguide with a circular cross section, propagating the mm-wave signal in a TE11 operating mode.

in Example 42, the subject matter of any one or more of Examples 40-41 optionally include further comprising: means for launching an electromagnetic wave into the open end of a waveguide with a rectangular cross section, propagating the mm-wave signal in a TE10 operating mode.

In Example 43, the subject matter of any one or more of Examples 40-42 optionally include further comprising: means for generating a mm-wave signal with radio frequency circuitry connected to a signal line; and means for exciting the patch antenna through an antenna feed connected to the signal line wherein the antenna feed is positioned such that the patch antenna is resonating in the TM10 operating mode.

Example 44 is a storage medium comprising instructions that, when executed by one or more processors, implement any method described above.

Figure 11:
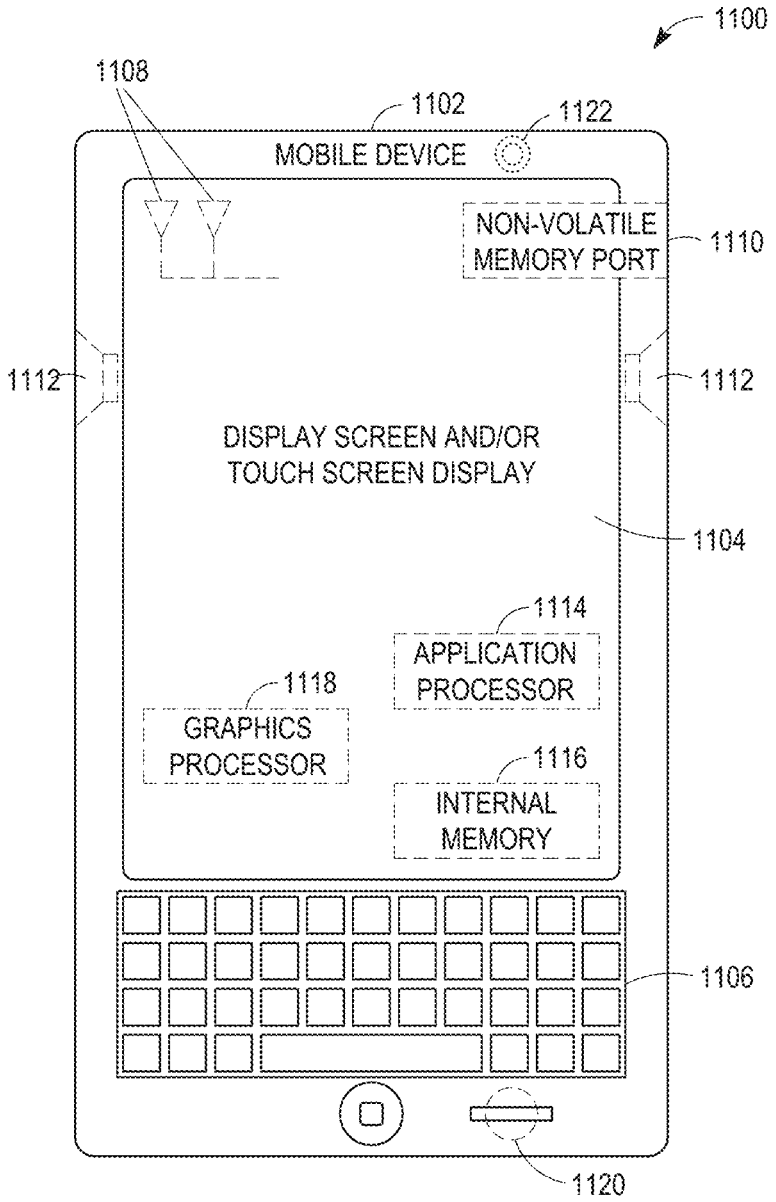
FIG. 11 illustrates an example of a device, which may be a communication system including circuitry to transmit and receive mm-wave signals with a plurality of waveguide adapters and a plurality of waveguides in accordance with some embodiments.

FIG. 11 illustrates an example of a device 1100, which may be a communication system including circuitry to transmit and receive mm-wave signals with a plurality of waveguide adapters and a plurality of waveguides in accordance with some embodiments. The device 1100 can be any mobile device, a mobile station (MS), a mobile wireless device, a mobile communication device, a tablet, a handset, laptop, wireless access point or other type of wireless communication device. The device 1100 can include one or more antennas 1108 within housing 1102 that are configured to communicate with a hotspot, base station (BS), an evolved node B (eNB) for cellular network access, or other type of WLAN or WWAN access point. The antennas 1108 may be connected to the plurality of waveguides. In other embodiments, the antennas 1108 could be omitted and the open ends of the waveguides could radiate directly into free space. The device 1100 may thus communicate with a WAN such as the Internet via a network, access point, or base station. The device 1100 can be configured to communicate using multiple wireless communication standards, including standards selected from 3GPP LTE, WiMAX, High Speed Packet Access (HSPA), Bluetooth, and Wi-Fi standard definitions. The device 1100 can communicate using separate antennas 1108 for each wireless communication standard or shared antennas 1108 for multiple wireless communication standards. The device 1100 can communicate in a WLAN, a WPAN, and/or a WWAN.

Additionally, in some embodiments, the antennas are each associated with a hole, slit, aperture, or other opening in a metal wall. In some embodiments, for example, a waveguide antenna array may have launch and receive signals via these slits or holes in a waveguide metal wall elsewhere than in the open end. In various embodiments, these openings may be made in any shape that enables communication with the corresponding signals, with a signal feed to one end of the waveguide metal wall, a short circuit on the other end, and the slots or openings along the waveguide metal wall.

FIG. 11 also shows a microphone 1120 and one or more speakers 1112 that can be used for audio input and output from the device 1100. A display screen 1104 can be a liquid crystal display (LCD) screen, or other type of display screen such as an organic light emitting diode (OLED) display. The display screen 1104 can be configured as a touch screen. The touch screen can use capacitive, resistive, or another type of touch screen technology. An application processor 1114 and a graphics processor 1118 can be coupled to internal memory 1116 to provide processing and display capabilities. A non-volatile memory port 1110 can also be used to provide data input/output options to a user. The non-volatile memory port 1110 can also be used to expand the memory capabilities of the device 1100. A keyboard 1106 can be integrated with the device 1100 or wirelessly connected to the device 1100 to provide additional user input. A virtual keyboard can also be provided using the touch screen. A camera 1122 located on the front (display screen) side or the rear side of the device 1100 can also be integrated into the housing 1102 of the device 1100.

Figure 12:
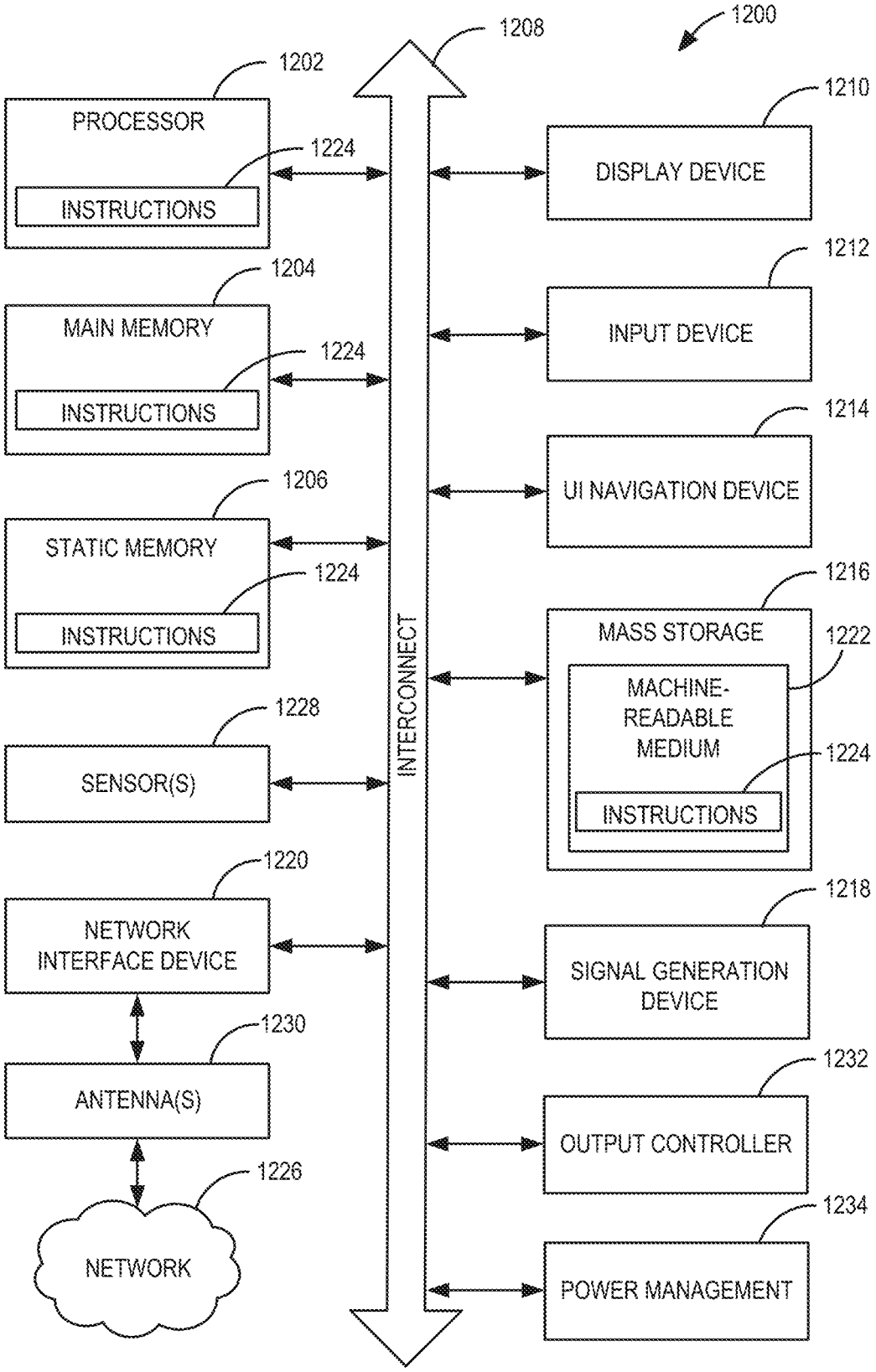
FIG. 12 is a block diagram illustrating an example computer system machine upon which any one or more of the methodologies herein discussed can be run in accordance with some embodiments.

FIG. 12 is a block diagram illustrating an example computer system machine 1200 upon which any one or more of the methodologies herein discussed can be run in accordance with some embodiments. Computer system machine 1200 or elements of computer system machine 1200 may be used to implement any device, a mobile phone, tablet, laptop wireless access point, wireless station device or any other such device described herein. In various other embodiments, different device components or multiple of any element may be used in different devices. Some embodiments may include other elements, such as phased array antennas, RF components for communication and radar, or other such elements integrated with any of the elements described herein for machine 1200. In various alternative embodiments, the machine 1200 operates as a standalone device or can be connected (e.g., networked) to other machines. In a networked deployment, the machine 1200 can operate in the capacity of either a server or a client machine in server-client network environments, or it can act as a peer machine in peer-to-peer (or distributed) network environments. The machine 1200 can be a personal computer (PC) that may or may not be portable (e.g., a notebook or a netbook), a tablet, a set-top box (SIB), a gaming console, a Personal Digital Assistant (PDA), a mobile telephone or smartphone, a web appliance, a network router, switch or bridge, or any machine capable of executing instructions (sequential or otherwise) that specify actions to be taken by that machine. Further, while only a single machine 1200 is illustrated, the term "machine" shall also be taken to include any collection of machines that individually or jointly execute a set (or multiple sets) of instructions to perform any one or more of the methodologies discussed herein.

Example computer system machine 1200 includes a processor 1202 (e.g., a central processing unit (CPU), a graphics processing unit (GPU) or both), a main memory 1204 and a static memory 1206, which communicate with each other via an interconnect 1208 (e.g., a link, a bus, etc.). The computer system machine 1200 can further include a video display unit (device) 1210, an alphanumeric input device 1212 (e.g., a keyboard), and a user interface (UI) navigation device 1214 (e.g., a mouse). In one embodiment, the video display unit 1210, input device 1212 and UI navigation device 1214 are a touch screen display. The computer system machine 1200 can additionally include a storage device 1216 (e.g., a drive unit), a signal generation device 1218 (e.g., a speaker), an output controller 1232, a power management controller 1234, and a network interface device 1220 (which can include or operably communicate with one or more antennas 1230, transceivers, or other wireless communications hardware), and one or more sensors 1228, such as a Global Positioning Sensor (GPS) sensor, compass, location sensor, accelerometer, or other sensor.

The storage device 1216 includes a machine-readable medium 1222 on which is stored one or more sets of data structures and instructions 1224 (e.g., software) embodying or utilized by any one or more of the methodologies or functions described herein. The instructions 1224 can also reside, completely or at least partially, within the main memory 1204, static memory 1206, and/or within the processor 1202 during execution thereof by the computer system machine 1200, with the main memory 1204, static memory 1206, and the processor 1202 also constituting machine-readable media.

While the machine-readable medium 1222 is illustrated in an example embodiment to be a single medium, the term "machine-readable medium" can include a single medium or multiple media (e.g., a centralized or distributed database, and/or associated caches and servers) that store the one or more instructions 1224. The term "machine-readable medium" shall also be taken to include any tangible medium that is capable of storing, encoding or carrying instructions (e.g., instructions 1224) for execution by the machine 1200 and that cause the machine 1200 to perform any one or more of the methodologies of the present disclosure or that is capable of storing, encoding or carrying data structures utilized by or associated with such instructions.

The instructions 1224 can further be transmitted or received over a communications network 1226 using a transmission medium via the network interface device 1220 utilizing any one of a number of well-known transfer protocols (e.g., HTTP). The term "transmission medium" shall be taken to include any intangible medium that is capable of storing, encoding, or carrying instructions for execution by the machine, and includes digital or analog communications signals or other intangible medium to facilitate communication of such software.

Various techniques, or certain aspects or portions thereof may take the form of program code (i.e., instructions) embodied in tangible media, such as floppy diskettes, CD-ROMs, hard drives, non-transitory computer-readable storage medium, or any other machine-readable storage medium wherein, when the program code is loaded into and executed by a machine, such as a computer, the machine becomes an apparatus for practicing the various techniques. In the case of program code execution on programmable computers, the computing device may include a processor, a storage medium readable by the processor (including volatile and non-volatile memory and/or storage elements), at least one input device, and at least one output device. The volatile and non-volatile memory and/or storage elements may be a RAM, EPROM, flash drive, optical drive, magnetic hard drive, or other medium for storing electronic data. The base station and mobile station may also include a transceiver module, a counter module, a processing module, and/or a clock module or timer module. One or more programs that may implement or utilize the various techniques described herein may use an application programming interface (API), reusable controls, and the like. Such programs may be implemented in a high level procedural or object-oriented programming language to communicate with a computer system. However, the program(s) may be implemented in assembly or machine language, if desired. In any case, the language may be a compiled or interpreted language, and combined with hardware implementations.

Various embodiments may use 3GPP LTE/LTE-A, IEEE 1002.11, and Bluetooth communication standards. Various alternative embodiments may use a variety of other WWAN, WLAN, and WPAN protocols and standards can be used in connection with the techniques described herein. These standards include, but are not limited to, other standards from 3GPP (e.g., HSPA+, UMTS), IEEE 1002.16 (e.g., 1002.16p), or Bluetooth (e.g., Bluetooth 9.0, or like standards defined by the Bluetooth Special Interest Group) standards families. Other applicable network configurations can be included within the scope of the presently described communication networks. It will be understood that communications on such communication networks can be facilitated using any number of personal area networks, LANs, and WANs, using any combination of wired or wireless transmission mediums.

The embodiments described above can be implemented in one or a combination of hardware, firmware, and software. Various methods or techniques, or certain aspects or portions thereof, can take the form of program code (i.e., instructions) embodied in tangible media, such as flash memory, hard drives, portable storage devices, read-only memory (ROM), random-access memory (RAM), semiconductor memory devices (e.g., Electrically Programmable Read-Only Memory (EPROM), Electrically Erasable Programmable Read-Only Memory (EEPROM)), magnetic disk storage media, optical storage media, and any other machine-readable storage medium or storage device wherein, when the program code is loaded into and executed by a machine, such as a computer or networking device, the machine becomes an apparatus for practicing the various techniques.

A machine-readable storage medium or other storage device can include any non-transitory mechanism for storing information in a form readable by a machine e.g., a computer). In the case of program code executing on programmable computers, the computing device can include a processor, a storage medium readable by the processor (including volatile and non-volatile memory and/or storage elements), at least one input device, and at least one output device. It should be understood that the functional units or capabilities described in this specification have been referred to or labeled as components or modules in order to more particularly emphasize their implementation independence. For example, a component or module can be implemented as a hardware circuit comprising custom very-large-scale integration (VLSI) circuits or gate arrays, off-the-shelf semiconductors such as logic chips, transistors, or other discrete components. A component or module can also be implemented in programmable hardware devices such as field programmable gate arrays, programmable array logic, programmable logic devices, or the like. Components or modules can also be implemented in software for execution by various types of processors. An identified component or module of executable code can, for instance, comprise one or more physical or logical blocks of computer instructions, which can, for instance, be organized as an object, procedure, or function. Nevertheless, the executables of an identified component or module need not be physically located together, but can comprise disparate instructions stored in different locations which, when joined logically together, comprise the component or module and achieve the stated purpose for the component or module.

Indeed, a component or module of executable code can be a single instruction, or many instructions, and can even be distributed over several different code segments, among different programs, and across several memory devices. Similarly, operational data can be identified and illustrated herein within components or modules, and can be embodied in any suitable form and organized within any suitable type of data structure. The operational data can be collected as a single data set, or can be distributed over different locations including over different storage devices, and can exist, at least partially, merely as electronic signals on a system or network. The components or modules can be passive or active, including agents operable to perform desired functions.

We claim:

1. An electromagnetic transmission apparatus comprising:

a waveguide comprising an open end; and a patch antenna configured to resonate at an operating frequency of a transceiver and electrically coupled to the open end of the waveguide and configured to operate with a patch antenna electric field pattern that is compatible with an electric field pattern of the waveguide in an operating mode, where the open end of the waveguide is electrically isolated from an antenna ground plane associated with the patch antenna.

2. The apparatus of claim 1, wherein the waveguide is associated with a waveguide operating mode and a characteristic cutoff frequency;

wherein the characteristic cutoff frequency is less than a transceiver operating frequency;

wherein the waveguide comprises a circular-shaped cross section; and wherein the waveguide is configured for transmission of millimeter waves.

3. The apparatus of claim 2, wherein the patch antenna comprises a square-shaped surface configured to electrically couple to the waveguide; and wherein the patch antenna is electrically isolated from a substrate by a dielectric material having a relative permittivity of between 2.9 and 3.2 and a patch thickness of the patch antenna between 0.1 millimeters and 0.2 millimeters.

4. The apparatus of claim 3, wherein the waveguide comprises a right angle elbow joint and the patch antenna is configured to excite an electric field in a direction that is orthogonal to the plane formed by the right angle elbow joint.

5. The apparatus of claim 3, wherein the waveguide operating mode is Transverse Electric 1-1 (TE11) and the patch antenna operating mode is Transverse Magnetic 1-0 (TM10).

6. The apparatus of claim 1, wherein the open end of the waveguide is electrically isolated from the patch antenna.

7. The apparatus of claim 1, wherein the waveguide further comprises a second open end configured to radiate energy into free space.

8. The apparatus of claim 1, further comprising:

a printed circuit board (PCB) wherein the patch antenna is constructed with at least two metal layers of a plurality of metal layers comprised within the PCB; and a signal line connected to an antenna feed that is constructed within the PCB, wherein the antenna feed is configured to excite the patch antenna in a TM10 operating mode.

9. The apparatus of claim 8, further comprising radio frequency circuitry connected to the signal line configured to transmit and receive mm-wave signals through the electromagnetic millimeter wave (mm-wave) transmission apparatus.

10. The apparatus of claim 8, further comprising a plurality of signal lines, a plurality of patch antennas, and a plurality of waveguides, and further configured to transmit energy from each signal line of the plurality signal lines to one of the waveguides of the plurality of waveguides by exciting one of the patch antennas of the plurality of patch antennas.

11. The apparatus of claim 10, further comprising radio frequency circuitry connected to the plurality of signal lines configured to transmit and receive mm-wave signals through the electromagnetic millimeter wave (mm-wave) transmission apparatus.

12. The apparatus of claim 1, wherein:

the waveguide comprises a rectangular-shaped cross section; and the patch antenna comprises a rectangular-shaped surface configured to electrically couple to the waveguide.

13. The apparatus of claim 12, wherein the waveguide operating mode is Transverse Electric 1-0 (TE10) and the patch antenna operating mode is Transverse Magnetic 1-0 (TM10).

14. The apparatus of claim 5, wherein a patch antenna feed is connected to a location on the patch antenna to cause the patch antenna to resonate in a TM10 operating mode and exhibit a scattering reflection coefficient of less than −8 dB at the transceiver operating frequency.

15. A method of mm-wave signal transmission comprising:

exciting a patch antenna with a mm-wave signal and resonating the patch antenna in an operating mode;

coupling an electric field of the patch antenna with an open end of a waveguide positioned with the open end over the patch antenna, where the open end of the waveguide is electrically isolated from an antenna ground plane associated with the patch antenna; and launching an electromagnetic wave into the open end of the waveguide having an electric field pattern compatible with an electric field pattern of the patch antenna and wherein the waveguide comprises a cutoff frequency less than a frequency of the mm-wave signal.

16. The method of claim 15, further comprising:

launching an electromagnetic wave into the open end of a waveguide with a circular cross section and propagating the mm-wave signal in a TE11 operating mode;

wherein the patch antenna comprises a rectangular shaped-patch antenna; and wherein the patch antenna is configured to resonate in a TM10 operating mode.

17. The method of claim 15, further comprising:

launching an electromagnetic wave into the open end of a waveguide with a rectangular cross section, propagating the mm-wave signal in a TE10 operating mode.

18. The method of claim 15, further comprising:

generating a mm-wave signal with radio frequency circuitry connected to a signal line; and exciting the patch antenna through an antenna feed connected to the signal line wherein the antenna feed is positioned such that the patch antenna is resonating in the TM10 operating mode.

19. A non-transitory computer-readable medium comprising instructions that, when executed by one or more processors of a device comprising a wireless communication system, cause the device to:

electrically resonate a patch antenna in an operating mode at an operating frequency of the wireless communication system, producing an electric field which couples to an open end of a waveguide; and launch an electromagnetic wave into the waveguide propagating in a waveguide operating mode wherein an electric field pattern of the waveguide operating mode is compatible with the electric field of the operating mode of the patch antenna, where the open end of the waveguide is electrically isolated from an antenna ground plane associated with the patch antenna, wherein a cutoff frequency of the waveguide is less than the operating frequency.

20. The non-transitory computer-readable medium of claim 19, wherein:

the operating mode is a TM10 operating mode;

the patch antenna comprises a square-shaped surface configured to electrically couple to the waveguide;

the waveguide comprises a circular-shaped cross section; and the waveguide is configured for a TE11 operating mode.

21. The non-transitory computer-readable medium of claim 19, wherein the waveguide operating mode is Transverse Electric 1-1 (TE11) and the patch antenna operating mode is Transverse Magnetic 1-0 (TM10).

22. The non-transitory computer-readable medium of claim 19, further comprising instructions that cause the device to radiate energy into free space from a second open end of the waveguide.

23. The non-transitory computer-readable medium of claim 19, further comprising instructions that cause the device to receive mm-wave signals at a second open end of the waveguide.

24. The non-transitory computer-readable medium of claim 19, wherein:

the patch antenna comprises a square-shaped surface configured to electrically couple to the waveguide; and the waveguide comprises a rectangular-shaped cross section and configured for the TE10 operating mode.

25. A radio frequency front end module comprising:

a radio frequency integrated circuit (RFIC);

a plurality of waveguide adapters coupled to the RFIC;

a plurality of waveguides associated with a plurality of corresponding radiation patterns, and coupled to a corresponding waveguide adapter of the plurality of waveguide adapters, wherein the plurality of waveguides are associated with a waveguide operating mode and a characteristic cutoff frequency and wherein the characteristic cutoff frequency is less than a transceiver operating frequency; and a plurality of patch antennas corresponding to pairs of waveguide adapters and waveguides of the plurality of waveguide adapters and the plurality of waveguides, the plurality of patch antennas configured to resonate at the transceiver operating frequency and further configured to electrically couple to an open end of a corresponding waveguide of the plurality of waveguides;

wherein the plurality of patch antennas are further configured for a patch antenna operating mode associated with a patch antenna electric field pattern that is compatible with a waveguide electric field pattern associated with the plurality of corresponding radiation patterns, where the open end of the waveguide is electrically isolated from an antenna ground plane associated with the patch antenna.

26. The radio frequency front end module of claim 25, further comprising:

a substrate comprising one or more of: a printed circuit board, a glass substrate, a ceramic substrate, and a semiconductor substrate;

wherein the RFIC and the plurality of waveguide adapters are mounted to the substrate and coupled via a plurality of transmission lines.

* * * * *